US009869488B2

(12) United States Patent
Glenn et al.

(10) Patent No.: US 9,869,488 B2
(45) Date of Patent: Jan. 16, 2018

(54) HINGED HOLD-OPEN ASSEMBLY FOR ROOF VENTILATOR

(71) Applicants: Benjamin Glenn, Oklahoma City, OK (US); Barry Wagner, Oklahoma City, OK (US)

(72) Inventors: Benjamin Glenn, Oklahoma City, OK (US); Barry Wagner, Oklahoma City, OK (US)

(73) Assignee: Driploc, LLC, Oklahoma City, OK (US)

( * ) Notice: Subject to any disclaimer, the term of this patent is extended or adjusted under 35 U.S.C. 154(b) by 0 days.

(21) Appl. No.: 15/136,683

(22) Filed: Apr. 22, 2016

(65) Prior Publication Data

US 2017/0082318 A1 Mar. 23, 2017

Related U.S. Application Data

(60) Provisional application No. 62/151,307, filed on Apr. 22, 2016.

(51) Int. Cl.

| | |
|---|---|
| ***E05D 11/10*** | (2006.01) |
| ***F24F 13/32*** | (2006.01) |
| ***F24F 7/02*** | (2006.01) |
| ***E05D 7/00*** | (2006.01) |

(52) U.S. Cl.

CPC ..... *F24F 13/32* (2013.01); *E05D 7/00* (2013.01); *E05D 11/1078* (2013.01); *F24F 7/025* (2013.01)

(58) Field of Classification Search

CPC ... F24F 13/32; F24F 7/025; F24F 7/02; E05D 7/00; E05D 11/1078; E05D 11/10; E05D 11/1007; E05D 11/1028; E05D 11/1035; E05D 2011/1092; Y10T 16/54028; Y10T 16/54044; Y10T 16/551; Y10T 16/5513; Y10T 16/5515; Y10T 16/5518

See application file for complete search history.

(56) References Cited

U.S. PATENT DOCUMENTS

| | | | | | |
|---|---|---|---|---|---|
| 649,387 | A * | 5/1900 | Wright | E05D 11/1007 | 16/344 |
| 942,656 | A * | 12/1909 | Moore | E05F 3/16 | 16/49 |
| 1,151,397 | A * | 8/1915 | Robinson | E05D 11/1007 | 16/353 |
| 1,212,475 | A * | 1/1917 | Gillies | E05D 11/1078 | 16/329 |

(Continued)

*Primary Examiner* — Chuck Mah

(74) *Attorney, Agent, or Firm* — Warner J. Delaune; Baker Donelson, et al.

(57) ABSTRACT

A hinged hold-open assembly for roof ventilator lids is provided, comprising a pair of hinged assemblies attached between the lid and a vent base, wherein each hinged assembly includes a hinge member; a retainer bracket affixed to the vent base, wherein the retainer bracket includes an extended member having a plurality of position holes corresponding to a closed position and a plurality of open positions; a position arm affixed to the lid, wherein the position arm includes a locking hole alignable with one of the position holes of the retainer bracket; and a locking device adapted to insert into both the locking hole and the position hole when said holes are aligned.

3 Claims, 5 Drawing Sheets

(56) References Cited

U.S. PATENT DOCUMENTS

| | | | | | |
|---|---|---|---|---|---|
| 1,295,680 | A * | 2/1919 | Benson | A47B 27/02 | 108/4 |
| 1,481,742 | A * | 1/1924 | Riley | E05C 17/203 | 16/374 |
| 2,461,398 | A * | 2/1949 | Sands | E05C 19/182 | 292/290 |
| 2,837,203 | A * | 6/1958 | Reeser | B65G 19/28 | 16/375 |
| 3,664,514 | A * | 5/1972 | Drake | A47B 57/045 | 16/332 |
| 3,896,595 | A * | 7/1975 | Anghinetti | E05C 3/12 | 292/238 |
| 4,125,288 | A * | 11/1978 | Hunter | B60N 2/02 | 16/332 |
| 6,289,555 | B1 * | 9/2001 | Nguyen | F24F 7/025 | 16/235 |
| 6,311,367 | B1 * | 11/2001 | Larsen | E05F 3/221 | 16/375 |
| 7,500,655 | B1 * | 3/2009 | Smith | E06B 11/02 | 256/27 |
| 8,381,626 | B2 * | 2/2013 | Marsic | B27G 19/02 | 16/319 |
| 8,535,128 | B2 * | 9/2013 | Chwala | F24F 7/025 | 454/354 |
| 9,303,887 | B1 * | 4/2016 | Chwala | F24F 13/32 | |
| 9,435,556 | B1 * | 9/2016 | Chwala | F24F 13/32 | |
| 2007/0175467 | A1 * | 8/2007 | Liu | A47J 37/0704 | 126/25 R |

* cited by examiner

HINGED HOLD-OPEN ASSEMBLY FOR ROOF VENTILATOR

CROSS-REFERENCE TO RELATED APPLICATIONS

This nonprovisional application claims the benefit of priority to U.S. provisional application Ser. No. 62/151,307, filed on Apr. 22, 2015.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The invention relates generally to devices and methods used in rooftop ventilator systems, and more particularly to hinged hold-open devices that can be used to retain the cover in multiple positions for maintenance activities.

2. Description of Related Art

In commercial ventilation systems for buildings, larges fans are mounted over vents in a roof. For example, a fan-assisted vent at a restaurant permits an exhaust to be withdrawn from the kitchen. Through this vent, grease and other cooking residue are allowed to leave the building. After a period of use, the vent and the fan become contaminated with grease. Other cooking residue also becomes adhered to the fan blades and other surfaces. Such residue can be flammable and presents a fire hazard, and can also attract undesirable microbes and illness causing bacteria, requiring occasional cleaning.

In most of these systems, a rectangular base rises above the roof vent, and the open base is covered by a rectangular lid. The lid is sometimes referred to as a shoebox lid, because is similar in construction to a cardboard shoebox, but formed from sheet metal. A large hole exists in the lid, and the fan is securely mounted to the lid. Over time the fan becomes dirty and requires cleaning and maintenance. For maintenance purposes, the lid is typically hinged to the base, allowing a worker to raise the lid and rotate the lid and fan assembly away from the base for proper access.

The problem for many workers is that the lid can be difficult to grasp, requiring the worker to lift the edges of the lid with fingers, and then rotate the heavy fan and lid assembly back into a fixed open position. Given the dangers of the fan and lid assembly inadvertently falling in either direction, it is important to place it into the desired position safely and securely. Moreover, it is also important that the maintenance worker have the flexibility to position the fan and lid into a plurality of positions.

Therefore, there is a need for a device which can be attached to the lid and fan base that serves as a replacement hinge and which allows easier and safer positioning of the lid in an open configuration when maintenance is required. The device should be simple to install and use, and it should not require any irreversible modifications to the lid itself.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

The present invention is a hinged hold-open assembly which allows the lid on a rooftop ventilator to be locked into one of a plurality of positions.

Figure 1:
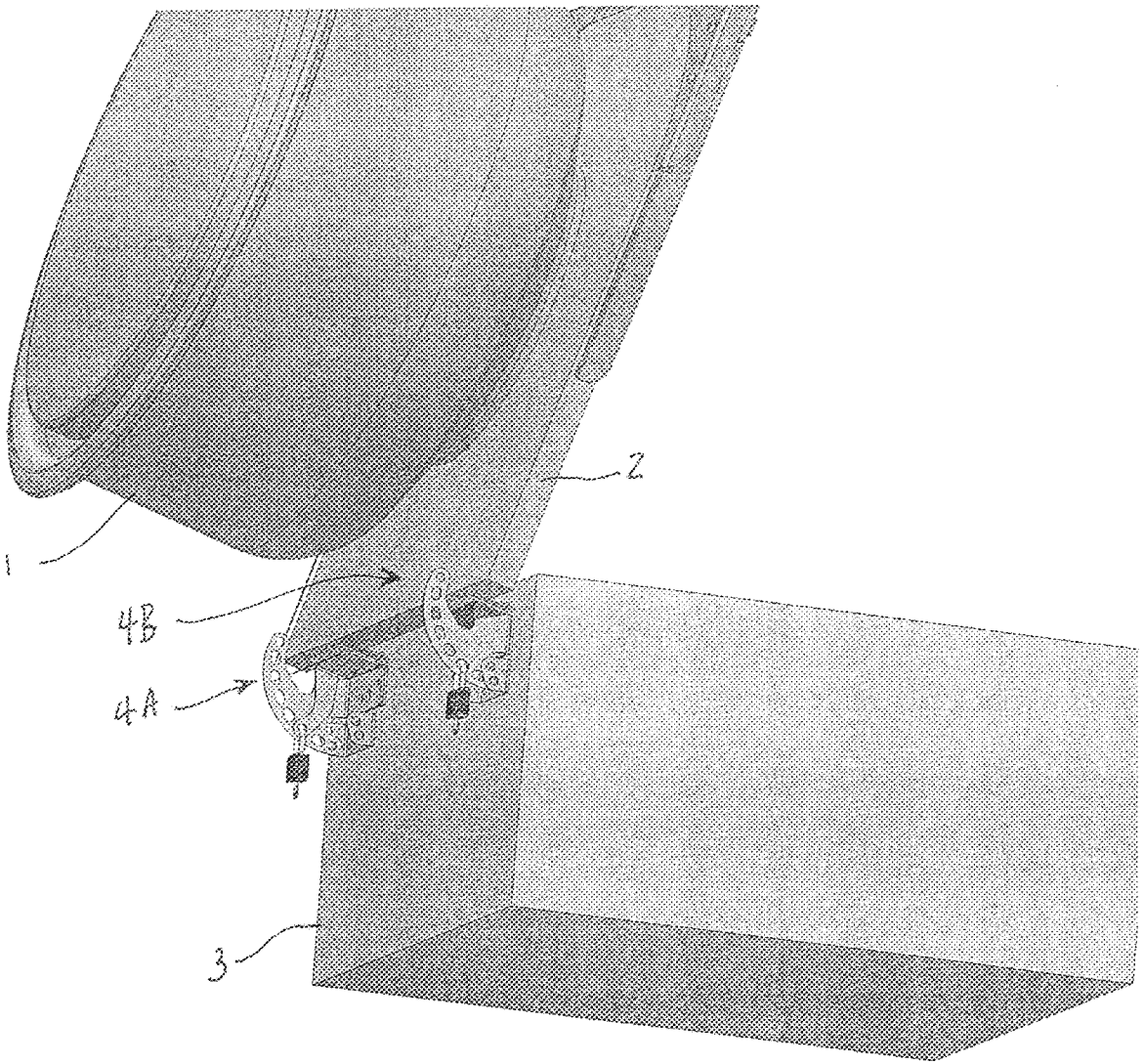
FIG. 1 shows a preferred embodiment of a hinged hold-open assembly of present invention showing the lid in an open position.
Figure 2:
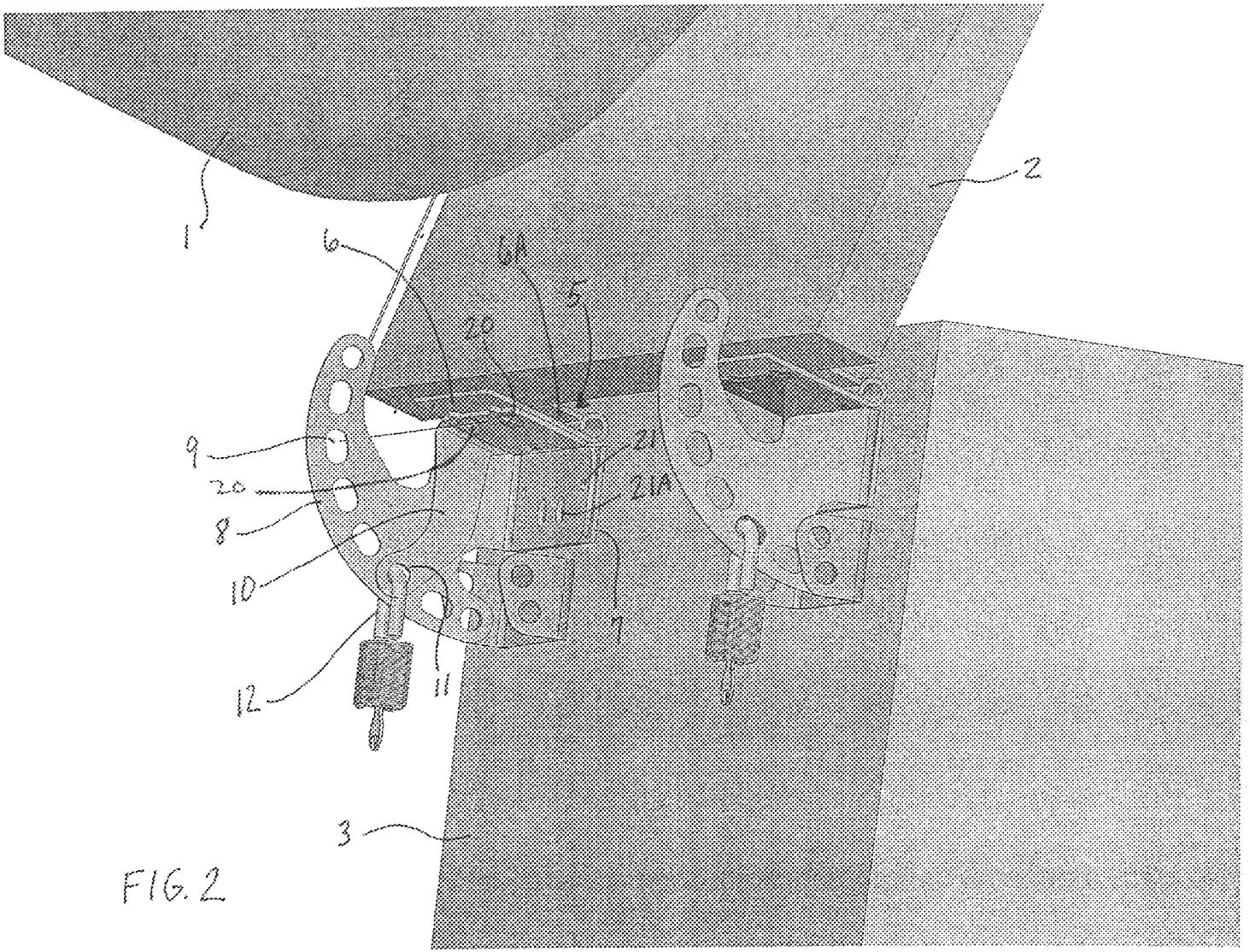
FIG. 2 shows a more detailed view of the hold-open assembly of FIG. 1.

As shown in the preferred embodiment of FIGS. 1 and 2, a fan 1 is fixed to a lid 2 which covers a vent base 3, wherein the fan 1 and lid 2 are hinged relative to the vent base 3. A pair of hold-open hinge assemblies 4A, 4B are operatively connected between the lid 2 and the vent base 3. The hold-open hinge assemblies 4A, 4B are constructed as described below, and they serve to lock the position of the lid 2 into a desired position for maintenance.

Figure 3:
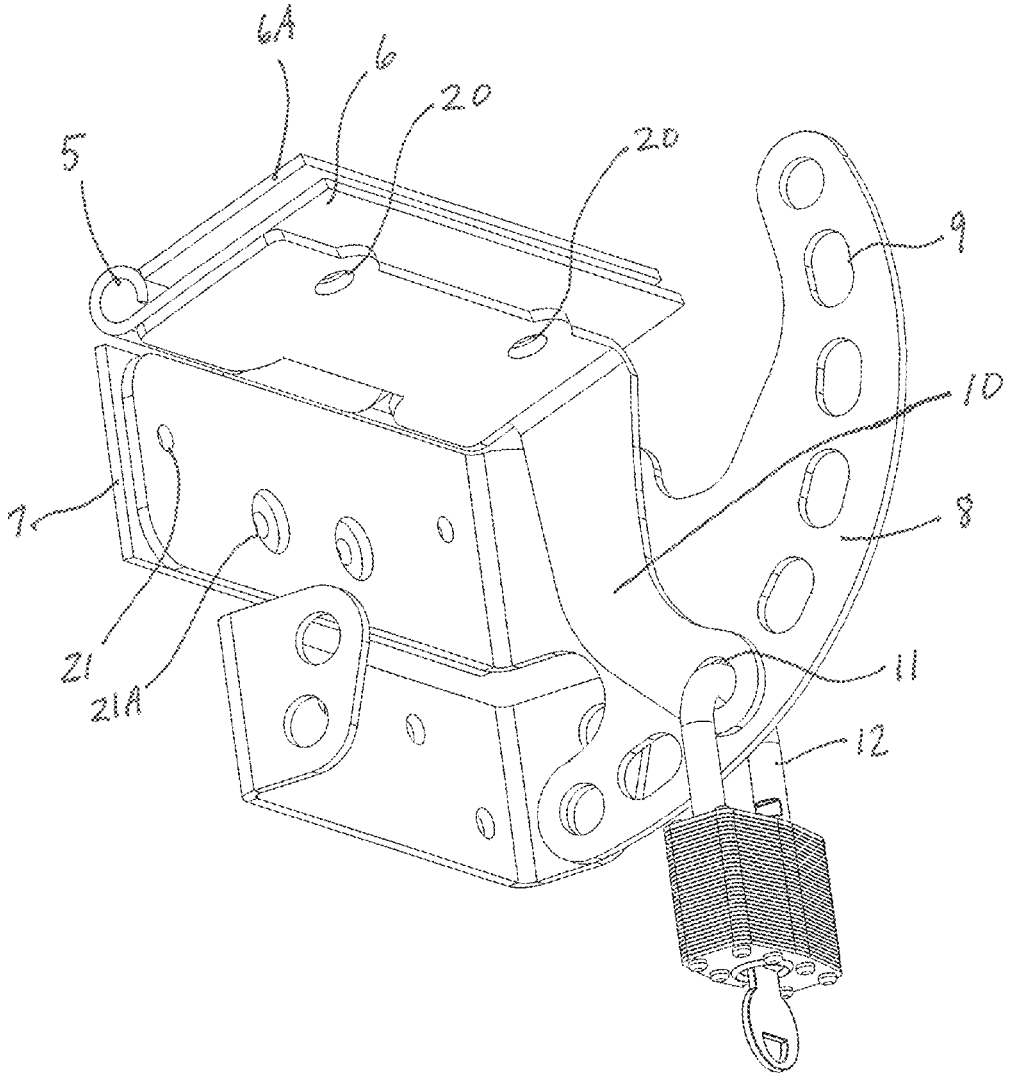
FIG. 3 shows a view of the hinge assembly of FIG. 1.

As shown in more detail in FIGS. 2 and 3, each hold-open hinge assembly 4A, 4B comprises a hinge 5, having an upper hinge plate 6 and a lower hinge plate 7. The upper hinge plate 6 includes mounting holes 20 and is fastened to the lid 2 using conventional bolts or screws (not shown for clarity, but identical to fasteners 30A in FIG. 4) inserted through mounting holes 20. The fasteners 30A which secure the upper hinge plate 6 to the lid 2 also function as set screws. For example, upper hinge plate 6 includes an integrated rear plate 6A which is formed by bending behind upper hinge plate 6, such that a channel is formed. The lid 2, which is typically a "shoe box" style lid, slides into the channel formed between upper hinge plate 6 and rear plate 6A, and is retained by the set screw fasteners 30A.

Lower hinge plate 7 is also fastened to the vent base 3 by conventional fasteners which are inserted through mounting holes 21 in the lower hinge plate 7. A retainer bracket 8 is fastened to the vent base 3 and co-located with the lower hinge plate 7, wherein the retainer bracket 8 includes a plurality of position holes 9 formed in an arcuate path therein. At least two of the mounting holes 21A in the retainer bracket 8 can be formed larger to fit over fastener heads, while the remainder of the mounting holes 21 may simply allow for simultaneous fastening of both retainer bracket 8 and lower hinge plate 7. The locations of the position holes 9 in the retainer bracket 8 correspond to the path of a position arm 10 fastened to the lid 2, and co-located with the upper hinge plate 6. The position arm 10 includes a locking hole 11 which can be aligned with any of the position holes 9.

For example, when the lid 2 is closed, the locking hole 11 of the position arm 10 is aligned with the uppermost position hole 9 of the retainer bracket 8. As the lid 2 is opened, the position arm 10 travels along a downward arc, such that the locking hole 11 passes one or more position holes 9. As shown in FIG. 2, the lid 2 has been opened to approximately a 60 degree angle, causing the locking hole 11 to align with the sixth position hole 9. A locking device 12, such as a padlock as shown or a conventional pin and retainer, can be inserted into the aligned holes 9, 11 to retain the lid 2 in the desired position.

Figure 4:
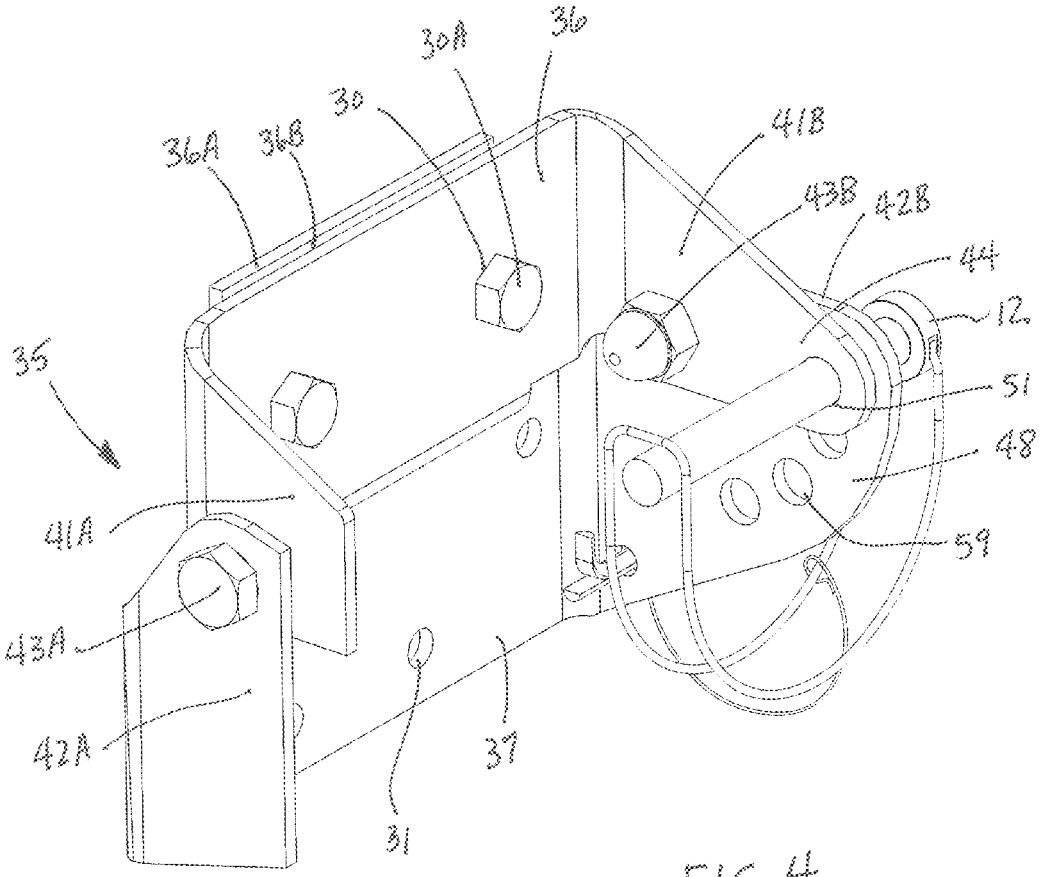
FIG. 4 shows an alternative embodiment of a hinge assembly for holding open the lid, depicting the front of the hinge.
Figure 5:
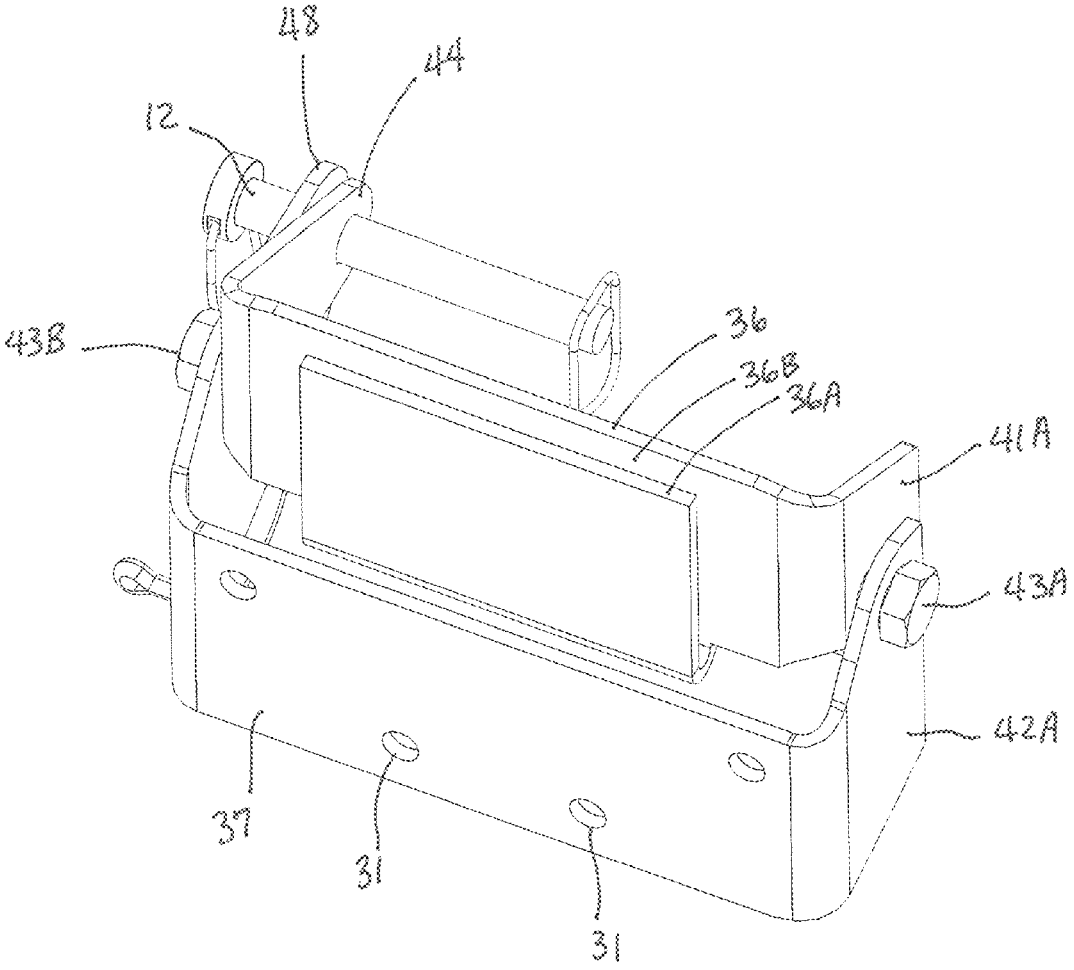
FIG. 5 shows the rear of the hinge of FIG. 4.

FIGS. 4 and 5 show an alternative embodiment of the present invention. FIG. 4 is a front view depicting a hinge 35, having an upper hinge plate 36 and a lower hinge plate 37. FIG. 5 shows a rear view of the hinge 35. The upper hinge plate 36 includes mounting holes 30 and is fastened to the lid 2 using conventional bolts or screws 30A inserted through mounting holes 30. The fasteners 30A which secure the upper hinge plate 36 to the lid 2 also function as set screws. For example, upper hinge plate 36 includes an integrated rear plate 36A which is formed by bending behind upper hinge plate 36, such that a channel 36B is formed. The lid 2, which is typically a "shoe box" style lid, slides into the channel 36B formed between upper hinge plate 36 and rear plate 36A, and is retained by the set screw fasteners 30A. Upper hinge plate 36 further includes hinge members 41A, 41B which are formed to reside in a flush relationship with corresponding members of lower hinge plate 37 as described below.

Lower hinge plate 37 is also fastened to the vent base 3 by conventional fasteners which are inserted through mounting holes 31 in the lower hinge plate 37. Lower hinge plate 37 further includes hinge members 42A, 42B which are formed to reside in a flush relationship with hinge members 41A, 41B of upper hinge plate 36. In this configuration, nut and bolt hinge axes 43A, 43B are inserted through hinge members 41A, 42A, and also hinge members 41B, 42B, respectively, resulting in an assembly which allows upper hinge plate 36 to hingedly rotate relative to lower hinge plate 37.

Lower hinge plate 37 further includes a retainer portion 48 which includes a plurality of position holes 59 formed in an arcuate path therein. Upper hinge plate 36 further includes a position arm 44 which includes a locking hole 51 which can be aligned with any of the position holes 59 in the retainer portion 48, similar to the operation of the preferred embodiment of FIGS. 1-3. A locking device 12, such as a padlock as shown in FIGS. 1-3 or a conventional pin and retainer as shown in FIG. 4, can be inserted into the aligned holes 51, 59 to retain the lid 2 in the desired position.

The hinged hold-open assembly 4A, 4B of FIGS. 1-3, as well as the alternative embodiment of the hinge 35 shown in FIGS. 4 and 5, are generally produced from a 10ga cold rolled low carbon steel, although other suitable materials may be used, such as aluminum. Being made of general metal material, the product will be either plasma cut, water jet cut, laser cut, punched or stamped from sheets or rolls of metal although new and better forms of parting the metal may be used as those methods become available. Once flat blanks of the various parts are produced using metal, the flat blanks will be formed using a press or die and generally powder-coated. If desired per customer request or specific design needs, final surfacing may be improved for the product's abilities to combat environmental conditions once in service, or to meet other desired characteristics.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A hinged hold-open assembly for roof ventilator lids, comprising:

a pair of hinged assemblies attached between the lid and a vent base, wherein the lid includes a rear lid side, and wherein the vent base includes a rear base side; and wherein each hinged assembly includes:

(a) a hinge member having a lower hinge plate and an upper hinge plate, wherein the upper hinge plate is attached to the rear lid side and the lower hinge plate is attached to the rear base side;

(b) a retainer bracket affixed to the lower hinge plate and the vent base, wherein the retainer bracket includes an arcuate-shaped extended member projecting from the rear base side and having a plurality of position holes corresponding to a closed lid position and a plurality of open lid positions;

(c) a position arm affixed to the upper hinge plate and the lid, wherein the position arm includes a locking hole alignable with one of the position holes of the retainer bracket; and (d) a locking device adapted to insert into both the locking hole and the position hole when said holes are aligned.

2. The assembly of claim 1, wherein the plurality of position holes on the extended member are formed along an arcuate path.

3. The assembly of claim 1, wherein the upper hinge plate includes a channel matingly engaged with the rear lid side.

* * * * *